US009815188B2

(12) United States Patent
Kaupp et al.

(10) Patent No.: US 9,815,188 B2
(45) Date of Patent: Nov. 14, 2017

(54) HANDLE FOR A WORK APPARATUS HAVING A DRIVE MOTOR

(71) Applicant: Andreas Stihl AG & Co. KG, Waiblingen (DE)

(72) Inventors: Klaus Kaupp, Stuttgart (DE); Cornelius Gindele, Plochingen (DE); Lothar Kotulla, Kirchheim Teck (DE); Pietro-Leon Schilling, Remseck (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 463 days.

(21) Appl. No.: 14/626,630

(22) Filed: Feb. 19, 2015

(65) Prior Publication Data

US 2015/0231779 A1 Aug. 20, 2015

(30) Foreign Application Priority Data

Feb. 19, 2014 (DE) ..... 10 2014 002 290

(51) Int. Cl.
*B25F 5/02* (2006.01)

(52) U.S. Cl.
CPC ..... *B25F 5/02* (2013.01)

(58) Field of Classification Search
CPC ... B25F 5/00; B25F 5/02; B26B 27/00; A47L 5/12; A47L 5/24; A47L 9/322; E01H 1/0809
USPC ..... 173/18, 170; 15/327.5, 344, 405
See application file for complete search history.

(56) References Cited

U.S. PATENT DOCUMENTS

2014/0158391 A1 6/2014 Xin et al.

FOREIGN PATENT DOCUMENTS

WO 2013/122267 A1 8/2013

*Primary Examiner* — Hemant M Desai
*Assistant Examiner* — William A Weller
(74) *Attorney, Agent, or Firm* — Walter Ottesen, P.A.

(57) ABSTRACT

A handle for a work apparatus has an actuation member for controlling the rpm of a drive motor of the work apparatus. The actuation member is mounted in the handle and has a pressure surface for the fingers of a user hand. In an initial position, the actuation member protrudes with its pressure surface beyond the grip surface of the handle and, in a position for continuous operation of the motor, has dipped into the grip surface so that the pressure surface of the actuation member lies at the level of the grip surface. A recess extends in the longitudinal direction of the handle and is formed in the grip surface. The recess overlaps the pressure surface of the actuation member so that the actuation member is displaced into the handle via the recess to a boost position whereat the pressure surface lies within the grip surface.

12 Claims, 3 Drawing Sheets

HANDLE FOR A WORK APPARATUS HAVING A DRIVE MOTOR

CROSS REFERENCE TO RELATED APPLICATION

This application claims priority of German patent application no. 10 2014 002 290.0, filed Feb. 19, 2014, the entire content of which is incorporated herein by reference.

FIELD OF THE INVENTION

The invention relates to a handle for a work apparatus with a drive motor and to an actuation member which is arranged in the handle for controlling the rotational speed of the drive motor.

BACKGROUND OF THE INVENTION

Work apparatuses with a drive motor such as motorized chainsaws, brushcutters, blowers or portable work apparatuses of the like are generally known. An actuation member is arranged in the handle for controlling the rotational speed of the drive motor, which actuation member has a pressure surface for supporting the fingers of a user's hand. In an initial position when the drive motor is at a standstill, the actuation member lies with its pressure surface above the grip surface of the handle; the actuation member protrudes out of the grip surface of the handle. When the user grips the handle, a plurality of fingers rest on the pressure surface of the actuation member and adjust the latter into an operating position for continuous operation of the rotating drive motor. The operating position for continuous operation is usually a regular, maximum operating position. In the operating position, the actuation member has dipped into the handle in such a way that the pressure surface of the actuation member lies at the same level as the grip surface of the handle.

During work using work apparatuses of this type, increased loads can occur on the implement which can lead to jamming of the work implement. In the case of blowers, there is frequently the desire to briefly increase the blower flow, in order to detach objects from an underlying surface which are difficult to release, such as damp leaves, damp paper or the like.

SUMMARY OF THE INVENTION

It is an object of the invention to provide a handle having an actuation member arranged therein in such a way that, in a simple manner, the user can select and hold a maximum operating position of the actuation member for continuous operation and, moreover, can set a selectable further actuation position for an increased power output (boost position).

The handle of the invention is for a work apparatus having a drive motor. The handle defines a longitudinal direction and includes: a handle body having a grip surface for a user of the work apparatus; an actuation member for controlling the rotational speed of the drive motor; the actuation member being mounted in the handle body and having a pressure surface for actuation via a finger of the user; the actuation member having an initial position whereat the actuation member with the pressure surface projects outwardly beyond the grip surface; the actuation member being movable so as to dip into the grip surface of the handle body to assume an operating position whereat the drive motor runs continuously and whereat the pressure surface of the actuation member lies at an elevation with the grip surface of the handle body; the grip surface having a recess formed therein in the region of the actuation member with the recess extending in the longitudinal direction of the handle; the actuation member being displaceable beyond the operating position to a boost position; the recess at least partially overlapping the pressure surface of the actuation member so as to cause the actuation member to be displaced into the handle body when assuming the boost position in the recess; and, the pressure surface of the actuation member lying within the grip surface when the actuation member is in the boost position.

In the region of the actuation member, a recess, which extends in the longitudinal direction of the handle, is formed in the grip surface of the handle. The recess at least partially overlaps the pressure surface of the actuation member in such a way that the actuation member can be displaced into a boost position by way of a finger of the user's hand via the recess in the handle, the pressure surface of the actuation member lying within the grip surface of the handle in the boost position.

As a result of this structural configuration, the user can select and hold a maximum operating position of the actuation member for continuous operation in a simple way by way of customary gripping around the grip surface of the handle and resting the fingers on the pressure surface of the actuation member. If the user wishes to call up increased performance, the user can grip with at least one finger in the recess and can pivot the actuation member into the handle beyond the maximum operating position for continuous operation. In this so-called boost position, the pressure surface of the actuation member lies within the grip surface of the handle; in this position, for example controlled via an additional switch, increased performance of the electric motor can be called up. A performance increase of from approximately 10% to 30% above the performance in the maximum operating position for continuous operation has proven advantageous.

The actuation member can also be coupled to a potentiometer, the output signal of which is fed to a controller for metering the electric power. If from approximately 80% to 90% of the possible actuating travel of the potentiometer has been passed through, the controller will meter a performance increase of from approximately 10% to 30% above the performance in the regular maximum operating position for continuous operation in accordance with the boost position of the actuation member.

The recess advantageously has a length which extends in the longitudinal direction of the handle and is smaller than the pressure surface of the actuation member, which pressure surface extends in the same direction. Here, the recess can be arranged in such a way that it lies within the length of the actuation member which extends in the longitudinal direction of the handle, that is, in such a way that the recess begins and ends in the region of the pressure surface in a side view of the handle.

The pressure surface of the actuation member is delimited by side faces which extend in the longitudinal direction of the handle, the recess being configured in the grip surface of the handle on both sides of the actuation member.

The recess is configured structurally in the longitudinal direction of the handle with a length which corresponds to the thickness of a standardized finger of a standardized user's hand. The recess advantageously has a length of from 10 mm to 50 mm, in particular a length from 15 mm to 30 mm.

The actuation member has to be adjusted counter to the force of a spring. In order to adjust the actuation member from the maximum operating position for continuous operation into a boost position, an increased spring force has to be overcome. As a result, the user senses haptically that the user has to overcome an increased actuation resistance before the user can pivot the actuation member into the boost position. This ensures that the boost position is not actuated unintentionally.

The spring which provides the increased spring force at the same time forms a resilient intermediate stop which determines the maximum operating position for continuous operation.

The boost position is assigned a boost stop which limits the adjustment travel of the actuation member, as a result of which the pivoting travel of the actuation member is limited structurally.

The actuation member is advantageously a pivoted lever, but can also be a lever or the like which is moved in a translational manner and can be displaced in a slotted guide.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
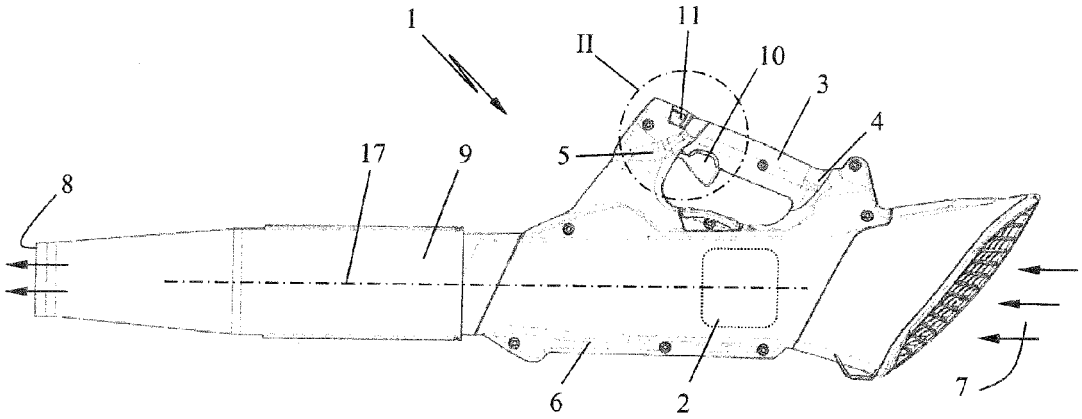
FIG. 1 shows a side view of a work apparatus with a drive motor using the example of a blower.

The work apparatus 1 which is shown in FIG. 1 is a blower with a drive motor 2 which is indicated using dashed lines. The work apparatus 1 has an upper handle 3 which is fixed at its back end 4 and at its front end 5 on the top side of the housing 6 of the work apparatus 1. A fan wheel, which is driven by the drive motor 2, draws air in the direction of the arrow 7 through a protective grille and expels it at the opening 8 of the blower tube 9. The work apparatus 1 (the blower in the embodiment shown) is an electrically operated work apparatus 1, that is, has an electric drive motor 2. A rechargeable battery pack which supplies the electric drive motor 2 with power can be pushed into the housing 6. The rechargeable battery pack can also be carried on the belt of a user or can be provided as a rechargeable battery pack which is carried on the back. A connection cable then leads from the rechargeable battery pack to the work apparatus.

Figure 4:
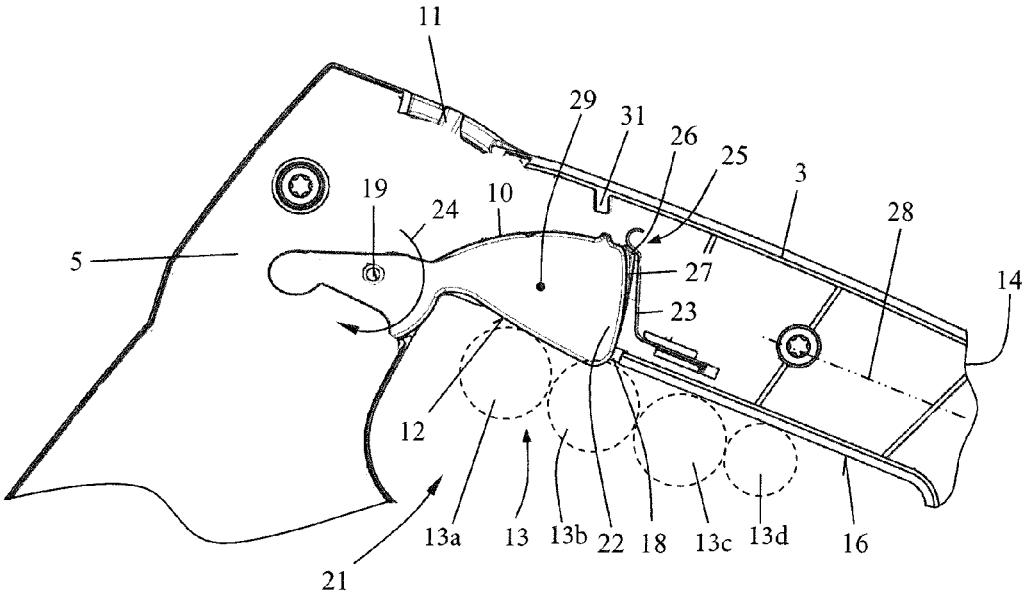
FIG. 4 shows a section along the handle in the maximum, regular operating position according to FIG. 3.

An actuation member 10 is mounted as a switching lever in the handle 3 in order to control the rotational speed of the electric drive motor 2. In the embodiment which is shown, the actuation member 10 lies close to the front end 5 and, in the embodiment, is mounted as a pivoting lever in the handle 3 (FIG. 4). The actuation member 10 can also be arranged in the handle in some other way, for example, by being displaceable via a slotted guide.

The actuation member 10 can be coupled to a potentiometer (not shown in greater detail), the output signal of which is fed to a controller for metering the electric power to the drive motor 2. The adjustment of the potentiometer by way of the actuation member takes place counter to the force of a spring. The spring acts in such a way that the actuation member is returned into its initial position.

Furthermore, a selection switch 11 for electrically setting fan stages is mounted in the region of the front end 5 of the handle 3. In each selected fan stage, a rotational speed increase with a different rise is implemented by the pivoting travel of the actuation member 10.

The actuation member 10, which is shown on an enlarged scale in FIGS. 2 to 5, has a pressure surface 12, on which the fingers 13 of a user's hand (not shown in greater detail) come to rest. In FIGS. 2 to 5, in each case the index finger 13*a*, the middle finger 13*b*, the ring finger 13*c* and the pinky finger 13*d* are indicated as circles of different diameter. As FIG. 3, in particular, shows, the pressure surface 12 is actuated substantially by the index finger 13*a* and the middle finger 13*b*. Here, the user's hand grips around the handle housing 14 of the handle 3, the top side of which forms an envelope curve 15. The envelope curve 15 at the same time forms the grip surface 16, namely, that section of the grip surface 16 of the handle which lies so as to face the housing 6 being of significance, in particular, within the context of the invention.

The actuation member 10, which is configured as a switching lever, lies within a frame which is formed by the handle 3, its ends 4 and 5 and the housing 6 of the work apparatus 1. The actuation member 10 extends in the longitudinal direction of the handle 3, the handle 3 lying such that it is oriented in the direction of the longitudinal center axis 17 of the work apparatus 1. The actuation member 10 which is configured as a switching lever is shown, in particular, in a side view in FIG. 4.

Figure 2:
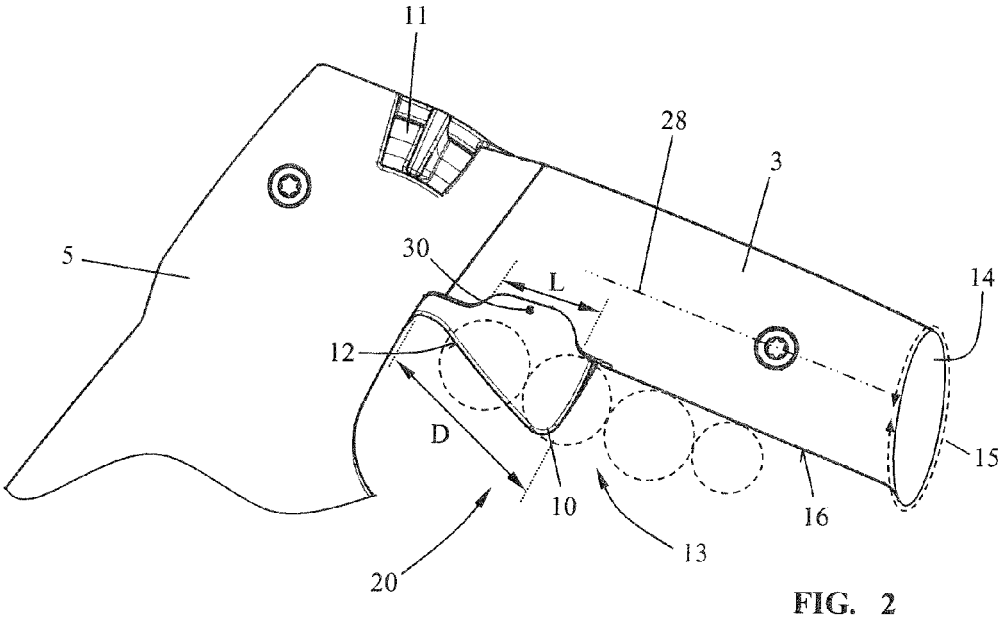
FIG. 2 shows an enlarged illustration of the handle with an actuation member according to detail II in FIG. 1.

In the non-actuated state, the actuation member 10 lies in an initial position 20, as shown in FIG. 2. In the initial position 20, the rotational speed of an electric drive motor 2 is "zero"; the drive motor 2 is at standstill. In the initial position 20, the pressure surface 12 of the actuation member 10 lies outside the envelope curve 15; the pressure surface 12 protrudes beyond the grip surface 16.

Figure 3:
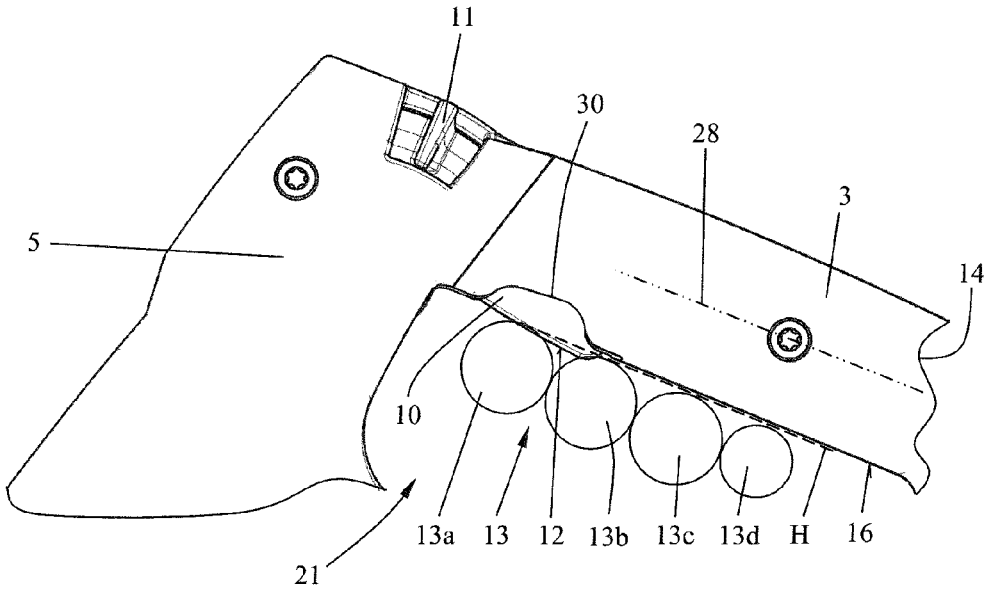
FIG. 3 shows an illustration of the pressed actuation member in the handle in a maximum, regular operating position for continuous operation.

In a regular operating position 21 of the actuation member 10 for continuous operation of the drive motor 2, the actuation member 10 is moved via the pressure surface 12 by the fingers 13*a* and 13*b* of the actuation hand of a user into the handle housing 14 of the handle 3, as FIG. 3 shows. The actuation member 10 has dipped through a receiving opening 18 (FIG. 4) of the handle 3 in such a way that the pressure surface 12 of the actuation member 10 lies at a level H together with the grip surface 16 of the handle 3 (FIG. 3). In the operating position which is actuated by the fingers 13 of a user's hand, the pressure surface 12 is loaded with force substantially by the index finger 13*a* and the middle finger 13*b*.

The maximum position of the regular operating position 21 for continuous operation of the drive motor 2 is reproduced in a sectional illustration in FIG. 4. The actuation member 10 is mounted in the region of the front end 5 of the handle 3 such that it can be pivoted about a pivot axis 19; a return spring (not shown in greater detail), which acts on the pivotable actuation member 10, exerts a returning force on the actuation member 10, in order to return it into its initial position 20 in the rotational direction 24. The profile of the operating force of the actuation lever is reproduced as a force curve 40 in FIG. 6. The actuation member 10 therefore has to be adjusted counter to the force of a return spring.

A spring 23 (a leaf spring in the embodiment), which is arranged at the free end 22 of the actuation member 10, has a formed step 26 at its free end 25. A cam 27 of the actuation member 10 bears against the step 26 when the actuation member 10 is pivoted counter to the rotational direction 24 into its maximum, regular operating position 21 for continuous operation. This contact of the cam 27 with the step 26 of the spring 23 is shown as a force peak 41 in the force curve 40. When the cam 27 comes into contact with the step 26, the user senses the increased actuation force (force peak 41) and can thus determine that he/she has reached the regular, maximum operating position 21 of the actuation member 10 for continuous operation.

The maximum, regular operating position 21 is configured electrically in such a way that an operating time of the work apparatus 1, which is as long as possible, is achieved by way of a connected rechargeable battery pack. Here, the configuration is selected in such a way that sufficiently high performance is provided which is required for regular work. For maximum performance of the work apparatus 1, the actuation member is assigned a boost position 33 as will be explained in greater detail hereinafter.

Figure 5:
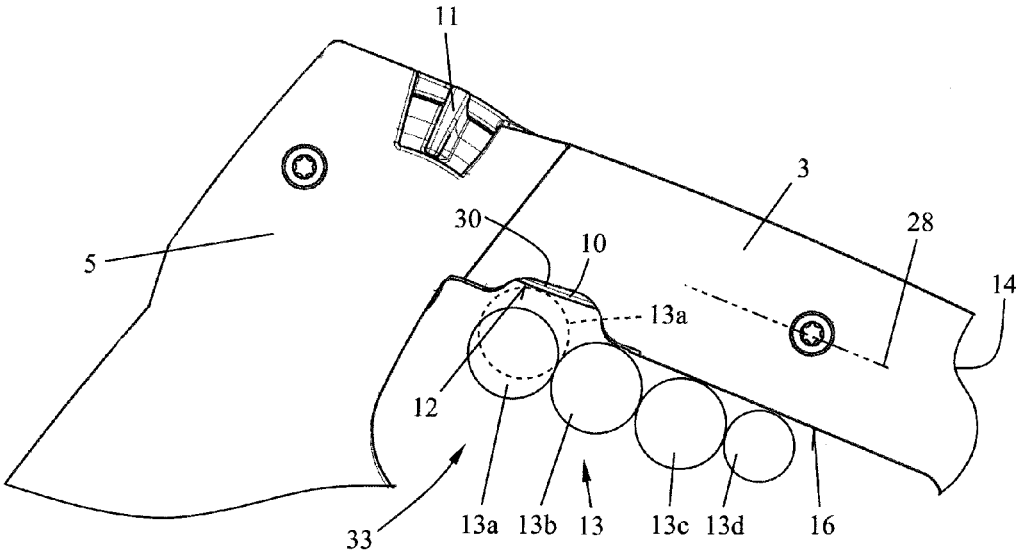
FIG. 5 shows an illustration of the handle according to FIG. 3 with an actuation member which lies in the boost position; and, FIG. 6 shows a diagram illustrating the rotational speed (rpm) of the drive motor and the operating force of the actuation member depending on the switching position.

As shown in FIGS. 2, 3 and 5, a recess 30, which extends in the longitudinal direction 28 of the handle 3, is formed in the grip surface 16 of the handle 3 in the region of the actuation member 10. A recess 30 expediently lies in the grip surface 16 of the handle 3 on both longitudinal sides 29 of the actuation member 10, with the result that the recess extends transversely with respect to the longitudinal direction 28 of the handle 3.

Figure 6:
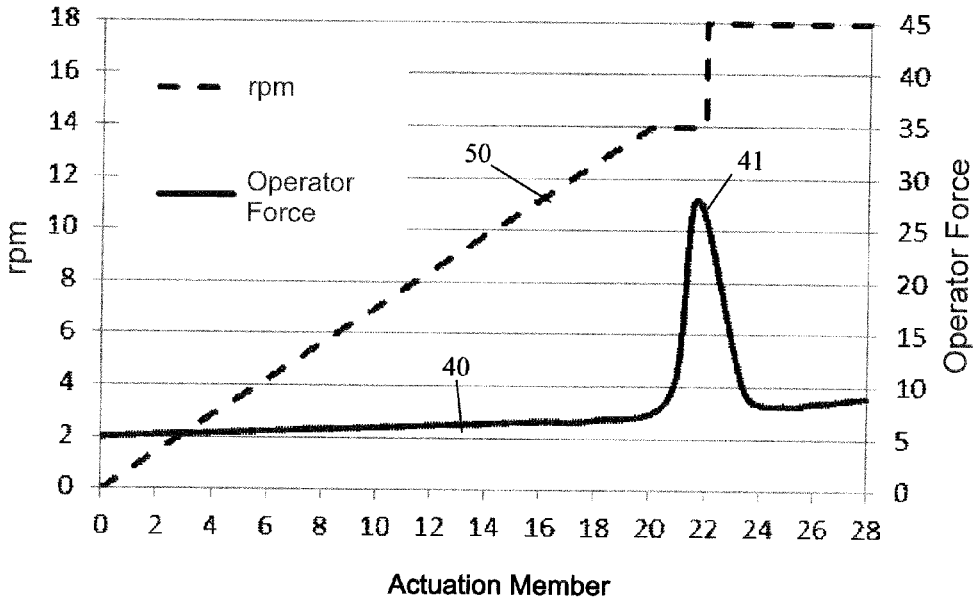

It is sufficient in principle if the recess 30 at least partially overlaps the pressure surface 12 of the actuation member 10 in such a way that the actuation member 10 can be displaced further into the handle 3 in a boost position 33 by way, for example, of a finger 13*a* of the user's hand via the recess 30. The actuation member 10 can therefore be pivoted beyond the maximum operating position for continuous operation into the boost position 33, in which the pressure surface 12 of the actuation member 10 lies within the envelope curve 15 of the handle 3, that is, within the grip surface 16 of the handle 3. This is shown in FIG. 5. The user can pivot the actuation member 10 into the boost position 33 by way of engagement, for example, of the index finger 13*a* into the recess 30; in the boost position 33, the rotational speed of the drive motor 2 is increased significantly, for example is increased by up to 30% with respect to the rotational speed in the maximum, regular operating position 21 for continuous operation (FIG. 3). FIG. 6 shows the corresponding rotational speed curve 50.

In the embodiment which is shown, the recess 30 has a length L (FIG. 2), which is measured in the longitudinal direction 28 of the handle 3 and is less than the length D, extending in the same direction of the pressure surface 12 of the actuation member 10. Furthermore, the arrangement in the longitudinal direction 28 of the handle 3 is provided in such a way that the recess 30 lies within the length D, extending in the longitudinal direction 28 of the handle 3, of the pressure surface 12 of the actuation member 10. Here, the arrangement is selected in such a way that the recess 30 is formed in the grip surface 16 of the handle 3 on both side faces 29 of the actuation member 10, the two side faces 29 of the actuation member 10 which extend parallel to the longitudinal direction 28 of the handle delimiting the pressure surface 12 laterally.

The length L of the recess 30 which extends in the longitudinal direction 28 corresponds at least to the thickness of a finger 13 of a typical user's hand. It is provided structurally that the recess has a length L of from 10 mm to 50 mm in such a way that a large number of users can displace the actuation member 10 via the recess 30 into the boost position 33 by way of the user's hand or one or two fingers 13 of the user's hand. The length L can be provided in such a way that only one finger (for example, the index finger 13*a*) can trigger the boost position 33 of the actuation member 10, to which end a length of from 15 mm to 30 mm is advantageous. It can be practical to extend the length to up to 50 mm, in order that two fingers of the user can dip into the recess 30 at the same time, in order to adjust the actuation member 10 into the boost position 33.

The transition from the maximum operating position 21 for continuous operation according to FIGS. 3 and 4 into the boost position 33 according to FIG. 5 can be achieved only by overcoming an increased spring force. FIG. 6 shows this clearly. The rotational speed increases by up to 30% only after the force peak is overcome.

In order to achieve a defined end position of the actuation member 10 in the boost position 33, a boost stop 31 is provided within the handle housing 14. The boost stop 31 fixes the end of the adjustment travel of the actuation member 10.

It is understood that the foregoing description is that of the preferred embodiments of the invention and that various changes and modifications may be made thereto without departing from the spirit and scope of the invention as defined in the appended claims.

What is claimed is:

1. A handle for a work apparatus having a drive motor, the handle defining a longitudinal direction and comprising:

a handle body having a grip surface for a user of the work apparatus;

an actuation member for controlling a rotational speed of said drive motor;

said actuation member being mounted in said handle body and having a pressure surface for actuation via a finger of the user;

said actuation member having an initial position whereat said actuation member with said pressure surface projects outwardly beyond said grip surface;

said actuation member being movable so as to dip into said grip surface of said handle body to assume an operating position whereat said drive motor runs continuously and whereat said pressure surface of said actuation member lies at a slightly protruding elevation in relation to said grip surface of said handle body;

said grip surface having a recess formed therein in a region of said actuation member with said recess extending in said longitudinal direction of said handle;

said actuation member being displaceable beyond said operating position to a boost position;

said recess at least partially overlapping said pressure surface of said actuation member so as to cause said actuation member to be displaced into said handle body when assuming said boost position in said recess; and, said pressure surface of said actuation member lying within said grip surface when said actuation member is in said boost position.

2. The handle of claim 1, wherein said recess has a length (L) which extends in said longitudinal direction of said handle; and, said length (L) of said recess is shorter than said pressure surface when viewed in said longitudinal direction.

3. The handle of claim 2, wherein said pressure surface of said actuation member has a length (D) extending in the longitudinal direction of said handle; and, said recess lies within said length (D) of said actuation member.

4. The handle of claim 1, wherein said actuation member has first and second side surfaces extending in said longitudinal direction of said handle and said first and second side surfaces are configured to delimit said pressure surface; and, said recess in said grip surface is configured on both of said side surfaces of said actuation member.

5. The handle of claim 2, wherein said length (L) of said recess lies in a range of 10 mm to 50 mm.

6. The handle of claim 5, wherein said length (L) of said recess lies in a range of 15 mm to 30 mm.

7. The handle of claim 1, further comprising a spring operatively connected to said actuation member so as to cause said actuation member to be displaceable against the force of said spring.

8. The handle of claim 7, wherein said spring is configured so as to require a higher force to be overcome when displacing said actuation member from said operating position into said boost position.

9. The handle of claim 8, wherein said spring is configured to define a resilient intermediate stop determining said operating position for the continuous operation of said drive motor.

10. The handle of claim 1, further comprising a boost stop corresponding to said boost position to delimit the travel path of said actuation member.

11. The handle of claim 1, wherein said actuation member is a pivot lever.

12. A handle for a work apparatus having a drive motor, the handle defining a longitudinal direction and comprising:

a handle housing, a top side of which forms a grip surface of the handle for a user of the work apparatus;

an actuation member for controlling a rotational speed of said drive motor;

said actuation member being mounted in said handle housing and having a pressure surface for actuation via a finger of the user;

said actuation member having an initial position whereat said actuation member projects with its pressure surface beyond said grip surface;

said actuation member being movable so as to dip into said grip surface of said handle housing to assume an operating position whereat said drive motor runs continuously and whereat said pressure surface of said actuation member lies at a same level as said grip surface of said handle housing;

said handle housing having a recess formed in said grip surface in a region of said actuation member with said recess extending in said longitudinal direction of said handle;

said actuation member being displaceable beyond said operating position to a boost position;

said recess at least partially overlapping said pressure surface of said actuation member so as to cause said actuation member to be displaced into said handle housing beyond the operating position for continuous operation in a boost position in said recess; and, said pressure surface of said actuation member lying within said grip surface of said handle housing when said actuation member is in said boost position.

* * * * *